United States Patent [19]

Dreier

[11] 4,388,885

[45] Jun. 21, 1983

[54] GAP STITCH MECHANISM FOR SEWING MACHINES

[75] Inventor: Ernst Dreier, Steckborn, Switzerland

[73] Assignee: Fritz Gegauf Aktiengesellschaft Bernina-Nähmaschinenfabrik, Steckborn, Switzerland

[21] Appl. No.: 192,712

[22] Filed: Oct. 1, 1980

[30] Foreign Application Priority Data

Oct. 1, 1979 [CH] Switzerland ..... 8800/79

[51] Int. Cl.[3] ..... D05B 69/02

[52] U.S. Cl. ..... 112/221

[58] Field of Search ..... 112/221, 220, 98, 158 R

[56] References Cited

U.S. PATENT DOCUMENTS

| | | | |
|---|---|---|---|
| 1,191,232 | 7/1916 | Richards | 112/221 |
| 3,507,236 | 4/1970 | Komuro | 112/221 X |
| 3,839,972 | 10/1974 | Scott et al. | 112/221 X |

*Primary Examiner*—Peter P. Nerbun

*Attorney, Agent, or Firm*—Birch, Stewart, Kolasch and Birch

[57] ABSTRACT

A gap stitch mechanism for a sewing machine containing a needle shaft which is oscillatingly driven by a crank assembly, wherein the crank assembly is provided with means for reducing the crank radius at predetermined intervals during the sewing operation, thereby determining the stroke of the needle shaft and making it impossible for the loop catcher to catch the needle thread.

12 Claims, 3 Drawing Figures

GAP STITCH MECHANISM FOR SEWING MACHINES

BACKGROUND AND SUMMARY OF THE INVENTION

The present invention is directed to a gap stitch mechanism for a sewing machine. The sewing machine is provided with a needle shaft which is oscillatingly driven by a crank assembly.

Gap stitch mechanisms are well known in the art. They include a cyclically controllable device which prohibits stitch formation at intervals. It is thus possible to form stitches several times the length of the forward feeding movement of the material. A known device of this type consists, for example, in stopping the needle shaft at intervals in its top dead center position, either by interrupting the needle shaft drive, as is shown, for example, in the Swiss Pat. No. 606,571, or by releasing the coupling at intervals between the feeder of the needle shaft drive and the needle shaft, as described, for example, in German Pat. No. 1,685,775. These gap stitch mechanisms usually have the disadvantage of creating excessive noise and causing rapid wear.

Accordingly, an object of the present invention is to provide a gap stitch mechanism which eliminates the need to connect and disconnect the needle shaft to prevent the formation of stitches, which leads to the disadvantages mentioned above. To this end, the present invention is characterized by the fact that means are provided for utilizing a crank assembly which reduces the crank radius, which in turn determines the needle shaft stroke, at predetermined intervals to the extent that it is impossible for the loop catcher to catch the needle thread. This solution eliminates the need for any additional interrupted needle shaft movement, i.e. the needle shaft operation continues at its normal operating rate thus, connecting and disconnecting the needle shaft and the crank mechanism are eliminated, as well as all noise and wear unavoidably associated with such processes.

It is customary to provide an arm shaft crank supported by the arm shaft of the device in the crank mechanism of the needle shaft drive, said arm shaft crank supporting a drive crank coupled with the needle shaft. The crank arm of this drive crank determines the crank radius which in turn determines the needle shaft stroke. One solution to the object according to the present invention comprises changing the crank radius by turning the drive crank in a bearing bore hole of the arm shaft crank. In an especially advantageous feature, an adjusting crank supporting the drive crank is turned in a bearing bore hole of the arm shaft crank, e.g. by way of an adjusting lever that is securely attached thereto. The adjusting lever works together with cams that can be chosen and moved into operating position. Since all drive members between the arm shaft and the needle shaft maintain their continuing movement pattern regardless of whether the drive has a full or abbreviated stroke, there is neither a large amount of noise generated, nor is there aggrevated wear, as would be the case without utilizing the gap stitch mechanism.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
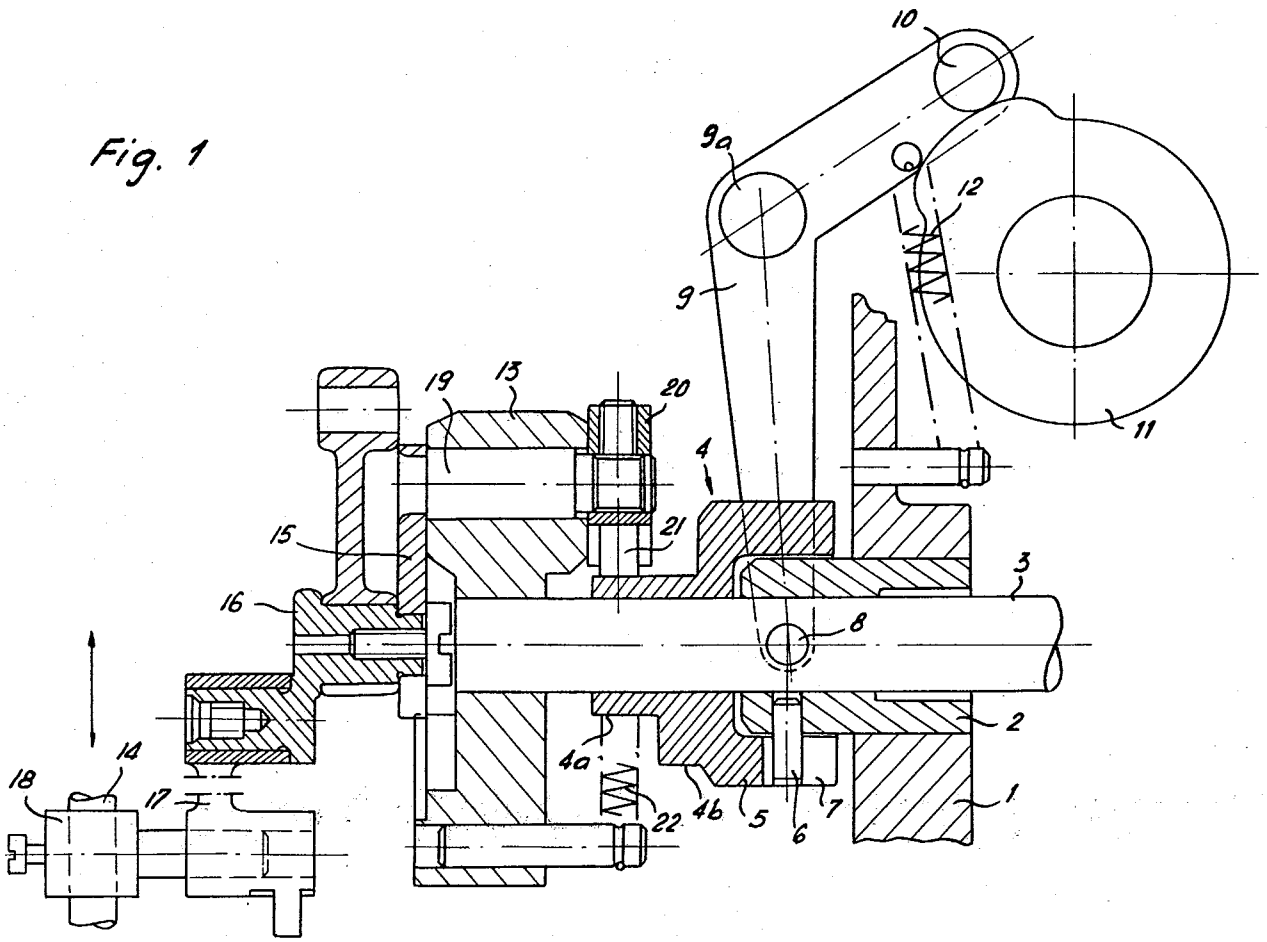
FIG. 1 shows the crank mechanism that serves the needle shaft drive of a sewing machine with a gap stitch mechanism, in vertical cross section.

In FIG. 1 a vertical cross wall of the head portion of the sewing machine arm is designated by element 1, in which a bearing bushing 2 is positioned. The drive-side end portion of arm shaft 3 extends through the bearing bushing. A cam sleeve 4 is disposed on the arm shaft 3. A collar 5 of the cam sleeve 4 surrounds the bearing bushing 2. A radial pin 6, fixed in the bearing bushing 2 engages in a longitudinal slot 7 of the collar 5. This permits the cam sleeve 4 to slide axially on the arm shaft 3, but secures it against turning. A bolt 8 extends into a milled recess 5*a* provided on the circumference of the collar, said bolt 8 being located on the free end of one arm of the double lever 9 which is attached to the machine arm. The other arm of the pivoting double lever 9, which is rotatable around the perpendicular axis 9*a* and horizontal to the arm shaft 3, supports a feeler roller 10 which works on an interval cam 11 and is held in contact with the latter by a spring 12. Other control means affecting the sliding of the cam sleeve at the desired intervals can be used in place of the cam to determine the desired gap stitch interval, such as for example, a linear or step motor, or magnets, and the like. The cam sleeve has two adjacently located cams 4*a* and 4*b*. Cam 4*b* joins collar 5 and has a cylindrical section coaxial with the arm shaft 3 and a radial cam section elevated thereabove. The other adjacent cam 4*a* is cylindrical and has the same radius as that section of cam 4*b* which is coaxially cylindrical with it. Thus it can be seen that the two cams 4*a* and 4*b* have a smooth and gradual axial transition from one to the other in the area of the cylindrical section of the cam 4*b*. The arm shaft crank 13 of the crank mechanism, which serves to provide the oscillating drive of needle shaft 14, sits on the arm shaft 3 in a known manner. An adjusting crank 15 is mounted in an axial bore hole in the arm shaft crank 13, and supports the customary drive crank 16, which is coupled by way of the swing arm 17 to the carrier 18, which sits on the needle shaft 14. An adjusting lever 20 is connected with axle 19 of the adjusting crank 15. The adjusting lever supports a feeler roller 21 which works together with cams 4*a* and 4*b* of the cam sleeve 4 and is held by a spring 22 in contact with these cams.

Figure 2:
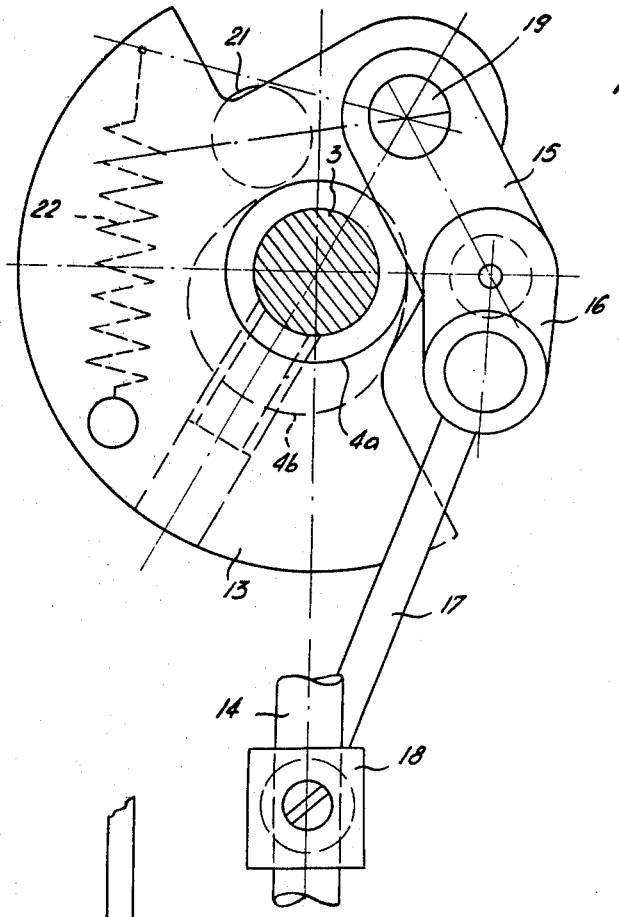
FIG. 2 shows a front view of FIG. 1.
Figure 3:
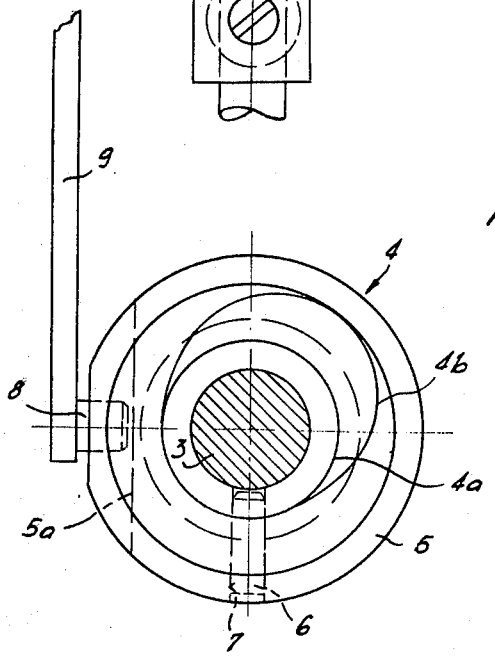
FIG. 3 shows a front view of the control means of the gap stitch mechanism according to FIGS. 1 and 2.

The operation of the device of the present invention is explained hereinbelow. FIGS. 1 and 2 show, the lob of cam 4*b* pointing in the downward direction, i.e., when the needle shaft 14 is at top dead center, the cam sleeve 4 can be slid axially with the feeler roller 21 being situated thereabove. In FIG. 1 a feeler roller 10 of the double lever 9 rests on the elevated lobe of the interval cam 11 so that the cam sleeve 4 is in its furthermost right end position. The feeler roller 21 then rests on the cylindrical cam 4*a* which corresponds to a pivoted position of adjusting lever 20 and thus the adjusting crank 15, which, with the rotation of the arm shaft crank 13, leads to a constant maximum crank radius and thus to a maximum needle shaft stroke. In sewing, the needle at the lowermost stroke position penetrates through the material, and the loop catcher lying therebelow catches the upper thread carried along by the needle, which then leads to the normal formation of a stitch. When the feeler roller 10 rolls down from the elevated lobe, as the interval cam 11 is further rotated, which, as previously mentioned, happens when the adjusting lever 20 and thus the feeler roller 21 rest on the upwardly positioned section of the cam 4*a*, which corresponds to the top dead center position of the needle shaft 4, the control sleeve 4 is pushed far enough to the left by a corresponding pivoting of the double lever 9 (clockwise in FIG. 1), so that the feeler roller 21 is located on the cylindrical section of cam 4*b*. As the arm shaft crank 13 continues to rotate, the feeler roller 21 rolls up onto the cam lobe of the cam 4*b*, causing a corresponding pivoting of adjusting lever 20 and thus adjusting crank 15, i.e., in the sense of a reduction of the crank radius which determines the stroke of the needle shaft (below). The lobe elevation of cam 4*b* is selected so that the stroke of the needle shaft is shortened enough so that the needle no longer reaches the material. This not only prevents the thread from being caught by the loop catcher, but also assures that there is no needle penetration into the sewing material. Depending on the length of the gap stitch interval of cam 11 or the number of rotations of the arm shaft crank per gap stitch interval of this cam, the result is a corresponding number of gap stitches. The control sleeve 4 is not pushed into its rightmost end position until the feeler roller 10 runs down again from the lobe of the interval cam 11, (which again takes place when the feeler roller of the adjusting lever 20 rests on top of the control sleeve 4). The feeler roller 21 of adjusting lever 20 again circumnavigates the cylindrical cam 4*a*, which corresponds to the maximum or bottommost needle shaft stroke, which then leads to the formation of normal stitches.

Since there is no interruption of the needle shaft drive with corresponding connecting and disconnecting steps, all of the discontinuances associated therewith which could lead to corresponding noise and wear, are eliminated. The adjusting movements themselves are small and have no influence on the continuous operation of the machine.

The gap stitch mechanism of the present invention is provided on a sewing machine whose needle shaft 14 is oscillatingly driven by a crank assembly represented by elements 13, 16, 17 and driven by the arm shaft 3. The drive crank 16 of the needle shaft 14 is supported by an adjusting crank 15 which is rotatingly mounted in the arm shaft 13. The rotating position of this adjusting crank 15 determines the crank radius, which then determines the needle shaft stroke. The position of the adjusting crank 15 is determined by way of an adjusting lever 20 provided with a feeler roller 21, by an adjustable control sleeve 4 disposed on the arm shaft 3, said control sleeve having two cams 4*a* and 4*b*. A cam 11, which is feeler sensed, determines both end positions of the control sleeve 4 corresponding to the desired gap stitch interval. In the one end position of the control sleeve the feeler roller 21 of the adjusting lever 20 rolls on a cylinder curve or cam 4*a* which provides the maximum needle shaft stroke, and thus, the formation of stitches. In the other end position of the control sleeve 4, the feeler roller 21 rolls on a curve or cam 4*b* with an elevated lobe. The adjusting crank 15 is rotated by the lobe so that the crank radius, and thus the needle shaft stroke, is reduced in a downward movement so that there is no formation of stitches.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A gap stitch mechanism for a sewing machine containing a needle shaft which is oscillatingly driven by a crank assembly, wherein the crank assembly is provided with means for reducing a crank radius at predetermined intervals during a sewing operation, thereby determining the stroke of the needle shaft and making it impossible for a loop catcher to catch a needle thread, a drive crank of the needle shaft being supported by an adjusting crank which is rotatable in a bearing bore hole of an arm shaft crank for the purpose of shortening the crank radius.

2. The gap stitch mechanism of claim 1, wherein the crank assembly includes an arm shaft crank operatively associated with a drive crank and a swing arm.

3. The gap stitch mechanism according to claim 1, wherein the drive crank is operatively associated with a needle shaft, said drive crank being rotatably mounted in a bearing bore hole disposed in the arm shaft crank of the crank assembly, for the purpose of shortening the crank radius.

4. The gap stitch mechanism according to any one of the claims 1 to 3, wherein a change over to a shortened needle shaft stroke takes place at top dead center of the needle shaft.

5. The gap stitch mechanism according to any one of the claims 1 to 3, wherein an adjusting lever is connected to a rotatable drive crank or adjusting crank and is provided to change the crank radius for determining the needle shaft stroke, said adjusting lever operating together with one of two cams of a cam sleeve which is brought into operating position relative to the one or the other cams by interval control means.

6. The gap stitch mechanism according to claim 4, wherein the cam sleeve is slidingly disposed on an arm shaft in the longitudinal direction but secured against rotation, and contains a cylindrical first cam disposed coaxial to the arm shaft, which, in combination with the adjusting lever, determines the crank radius which corresponds to the full needle shaft stroke to form stitches, and a second cam which extends radially beyond the corresponding cylinder section of one of the adjacent cylinder curves, causing a cyclical rotation of the adjusting lever, said rotation determining the shortening of the downward movement of the needle shaft stroke.

7. A gap stitch mechanism for a sewing machine comprising:

a frame member;

a drive shaft rotatably mounted on said frame member;

a crank assembly being operatively driven by said drive shaft;

a needle shaft being operatively oscillatingly driven by said crank assembly;

means for selectively reducing a crank radius of said crank assembly at predetermined intervals during a sewing operation for determining the stroke of the needle shaft to prevent a loop catcher from engaging a needle thread; and a drive crank of the needle shaft being supported by an adjusting crank being rotatable in a bearing bore hole of an arm shaft crank for the purpose of shortening the crank radius.

8. A gap stitch mechanism according to claim 7, and further including a feeler roller operatively connected to said arm shaft crank and a cam sleeve positioned on said drive shaft, said feeler roller being selectively movable between at least two positions on said cam sleeve for pivoting an adjusting lever operatively connected for imparting movement to said adjusting crank.

9. A gap stitch mechanism according to claim 8, and further including a double acting lever operatively connected to said sleeve cam for axially imparting movement thereto to engage and disengage said feeler roller with said at least two positions on said cam sleeve.

10. A gap stitch mechanism according to claim 9, and further including an interval cam operatively connected to said double acting lever for imparting movement thereto.

11. A gap stitch mechanism according to claim 8, wherein said cam sleeve is secured to said drive shaft to rotate therewith while permitting longitudinal movement.

12. A gap stitch mechanism according to claim 7, and further including a drive crank operatively connected to said adjusting crank and a swing arm operatively disposed between said drive crank and a carrier for holding said needle shaft.

* * * * *